US007334790B2

(12) United States Patent
Förch et al.

(10) Patent No.: US 7,334,790 B2
(45) Date of Patent: Feb. 26, 2008

(54) APPARATUS FOR CONVEYING SHEETS THROUGH A ROTARY PRESS

(75) Inventors: Peter Förch, Neustadt (DE); Markus Möhringer, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 278 days.

(21) Appl. No.: 11/256,600

(22) Filed: Oct. 21, 2005

(65) Prior Publication Data

US 2006/0181002 A1 Aug. 17, 2006

(30) Foreign Application Priority Data

Oct. 29, 2004 (DE) ..... 10 2004 052 657

(51) Int. Cl.
*B65H 29/04* (2006.01)

(52) U.S. Cl. ..... 271/204; 271/277; 271/275; 271/198; 271/205; 101/232; 101/407.1; 101/408

(58) Field of Classification Search ..... 271/204, 271/205, 277, 198, 275; 101/232, 407.1, 101/408

See application file for complete search history.

(56) References Cited

U.S. PATENT DOCUMENTS 2,366,930 A * 1/1945 Pirie ..... 74/613
4,399,767 A * 8/1983 Simeth ..... 118/46
4,735,141 A * 4/1988 Becker ..... 101/232
5,125,334 A * 6/1992 Marx et al. ..... 101/183
5,641,159 A * 6/1997 Greive et al. ..... 271/272
6,592,121 B2 * 7/2003 Frank et al. ..... 271/270
2002/0060409 A1 * 5/2002 Hess et al. ..... 271/198
2004/0124579 A1 * 7/2004 Schafer et al. ..... 271/182

FOREIGN PATENT DOCUMENTS

DE 36 14 734 A1 11/1987
DE 39 36 345 C1 3/1991
DE 195 11 682 A1 10/1996
DE 101 55 033 A1 8/2002

* cited by examiner

*Primary Examiner*—Patrick Mackey
*Assistant Examiner*—Luis A Gonzalez
(74) *Attorney, Agent, or Firm*—Laurence A. Greenberg; Werner H. Stemer; Ralph E. Locher

(57) ABSTRACT

Sheets are conveyed through a rotary press with linear travel grippers. The novel conveying apparatus prevents collisions between the grippers and printing unit cylinders. The grippers are fixed to circulating links to convey a sheet through a nip between two cylinders that interact during printing. The links and the cylinders are coupled to drives that can be activated separately. In each case a collision disk is mounted on a shaft journal of at least one cylinder. A slip clutch is provided between the collision disk and the cylinder. A braking element is coupled to the grippers which, in the event of non-synchronous running with the cylinder, runs onto the collision disk and prevents the collision disk from moving.

7 Claims, 3 Drawing Sheets

APPARATUS FOR CONVEYING SHEETS THROUGH A ROTARY PRESS

BACKGROUND OF THE INVENTION

Field of the Invention

The invention relates to an apparatus for conveying sheets through a rotary press, having grippers fixed to circulating links in order to convey a sheet through a nip between two cylinders that interact during printing. The links and the cylinders are coupled to drives that can be activated separately.

Sheet-fed rotary presses are known wherein the sheets are conveyed through the machine held by grippers. The grippers are located on gripper bars, which are moved through the machine by a chain mechanism or by linear motors. This type of sheet conveyance makes it possible to convey the sheets virtually on a straight line. The grippers are moved synchronously with the printing unit cylinders. In the case of a linear press for offset printing, channels are provided on the impression cylinder and/or the transfer cylinder, wherein channels the gripper bars with the grippers dip during conveyance. If a fault occurs in the drive of the grippers and/or the printing unit cylinders, there is then the risk of the grippers colliding with the printing unit cylinders. In the case of machines wherein sheets are conveyed in grippers both at the leading edge and at the trailing edge, the drives for the leading edge grippers and trailing edge grippers can be controlled separately as a function of the sheet length. If the drives for the leading edge and trailing edge grippers come out of synchronism, then there is also the risk of the gripper bars colliding with one another.

SUMMARY OF THE INVENTION

It is accordingly an object of the invention to provide an apparatus for conveying sheets through a rotary printing machine which overcomes the above-mentioned disadvantages of the heretofore-known devices and methods of this general type and which provides for an apparatus for conveying sheets through a rotary press with improved collision prevention between grippers and printing unit cylinders.

With the foregoing and other objects in view there is provided, in accordance with the invention, an apparatus for conveying sheets through a rotary press, the rotary press having shaft journal-mounted cylinders that interact during printing, comprising:

- grippers fixed to circulating links for conveying a sheet through a nip between the cylinders;
- separately activated drives for driving said links and the cylinders, respectively;
- a collision disk mounted on a shaft journal of at least one of the cylinders;
- a slipping clutch disposed between said collision disk and the respective cylinder; and
- a braking element coupled to said grippers, said braking element being disposed to, in an event of non-synchronous running with the respective cylinder, run onto said collision disk and prevent a movement of said collision disk.

According to the invention, a collision disk with a slipping clutch is arranged on a shaft journal of a cylinder. For the case wherein synchronism between the grippers and the cylinders is lost, a braking element revolving with the grippers is provided, which runs onto the collision disk and stops the collision disk moving. In the process, a limiting force on the slipping clutch is overcome, so that the cylinder continues to rotate.

It is possible to stop the sheet conveyance when the braking element runs onto the collision disk. The fact that it has run on can be registered by sensors, the sensor signals being processed by a control device which is connected to the drives for the printing unit cylinders and the grippers.

Furthermore, a centering disk having a radial centering groove can additionally be provided on a shaft journal of the cylinder or an adjacent cylinder so as to rotate with it. During synchronous running with the cylinders, a pin coupled to the grippers dips into the centering groove.

Other features which are considered as characteristic for the invention are set forth in the appended claims.

Although the invention is illustrated and described herein as embodied in a Apparatus for Conveying Sheets through a Rotary Press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
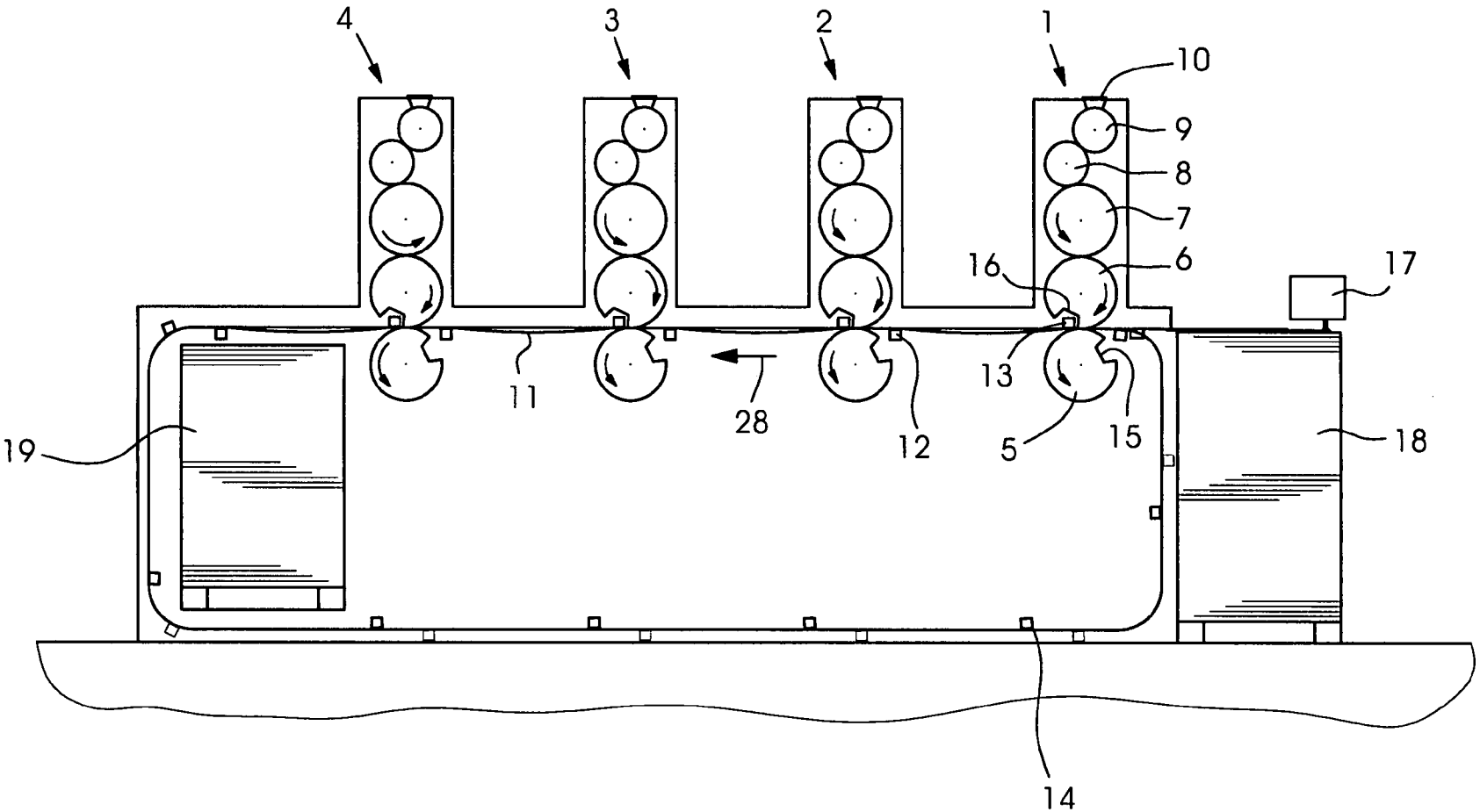
FIG. 1 is a schematic illustration of a linear press.

Referring now to the figures of the drawing in detail and first, particularly, to FIG. 1 thereof, there is shown a schematic drawing of a sheet-fed offset press with a straight sheet run through four printing units 1-4. Each printing unit 1-4 contains an impression cylinder 5, a transfer cylinder 6, a printing form cylinder 7, inking rolls 8, 9 and an ink metering device 10. To convey sheets 11, grippers which hold a sheet 11 at the leading edge and at the trailing edge are provided on gripper bars 12, 13. The gripper bars 12, 13 circulate on a path 14 which runs in a straight line between the printing units 1-4. The gripper bars 12 for the leading edges and the gripper bars 13 for the trailing edges of a sheet 11 are driven by linear motors. The cylinders 5-7 and rolls 8, 9 of the printing units are coupled to a gear train, to which at least one drive motor is assigned. The drive motor or motors for the printing units 1-4 and the linear motors are connected to a control and regulating device, which ensures that the cylinders 5-7 and gripper bars 12, 13 are driven synchronously. During synchronous driving, the gripper bars 12, 13 dip into channels 15, 16 which are in each case formed on the impression cylinder 5 and on the transfer cylinder 6. The sheets 11 are separated from a stack 18 by a suction head 17 and fed to the grippers of the gripper bars 12, 13. The printed sheets 11 are allowed to fall out of the grippers over a stack 19.

Figure 3:
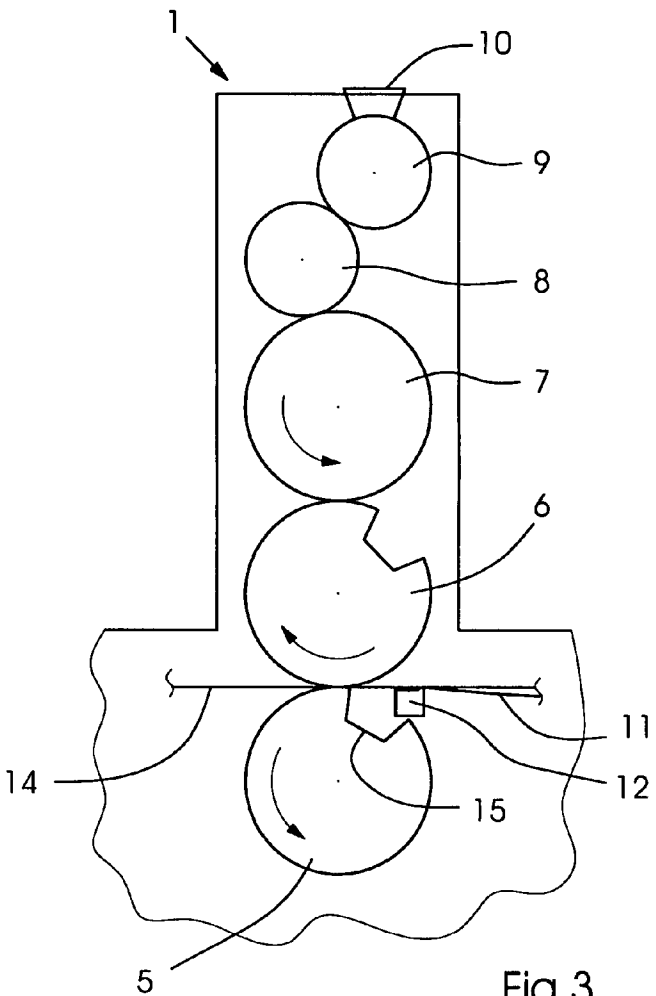
FIG. 3 is a diagram showing a collision between a gripper bar and the edge of a channel of an impression cylinder.
Figure 2:
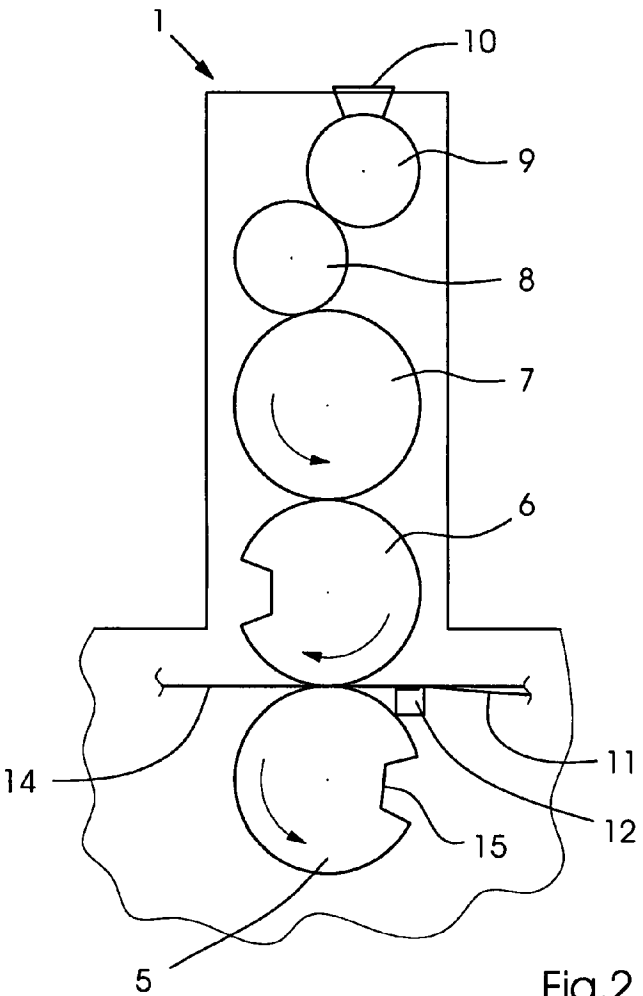
FIG. 2 is a diagram showing a collision between a gripper bar and the surface of an impression cylinder.

FIGS. 2 and 3 illustrate faults wherein the gripper bars 12, 13 are not running synchronously with the impression cylinder 5 and the transfer cylinder 6. In FIG. 2, the gripper bar 12 located below the path 14 for the leading edge of a sheet collides with the surface of the impression cylinder 5. In the case according to FIG. 3, there is only a slight deviation in the synchronous running. The gripper bar 12 collides with the trailing edge of the channel 15 of the impression cylinder 5.

Figure 5:
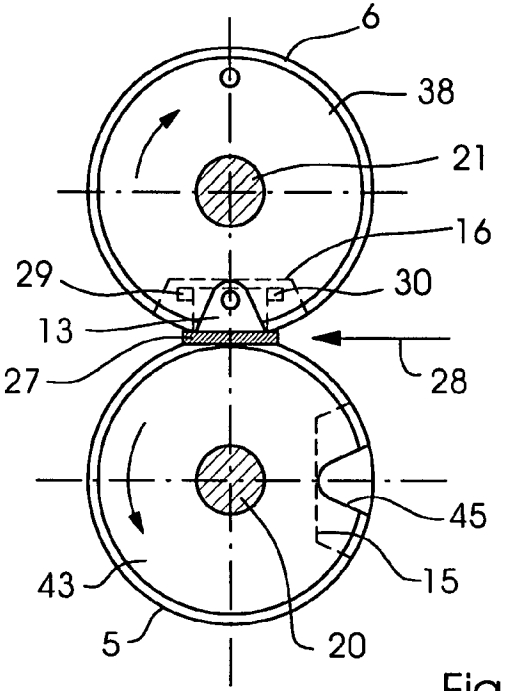
FIG. 5 is a section through the linear press taken along the line V-V in FIG. 4.
Figure 4:
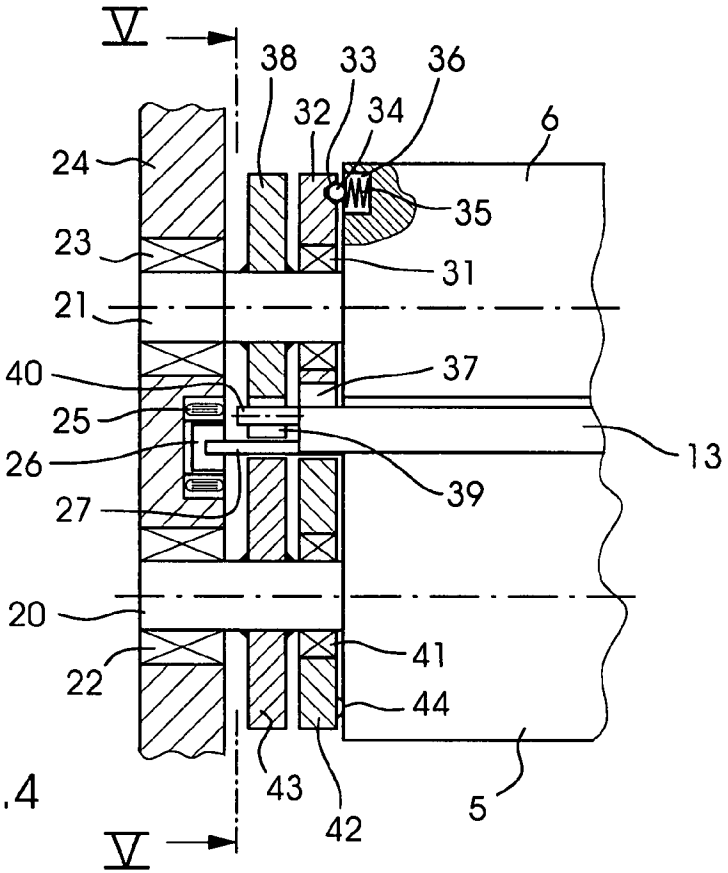
FIG. 4 is a partial cross section through a printing unit of the linear press according to FIG. 1.

In FIGS. 4-5, details of a printing unit 1-4 are illustrated in section. The impression cylinder 5 and the transfer cylinder 6 are held at their journals 20, 21 in bearings 22, 23 of a side wall 24 of the sheet-fed press. A passive part 25 of a linear motor is incorporated in the side wall 24 in accordance with the path 14. The passive part 25 simultaneously forms a guide for an active part 26 of the linear motor, which is coupled via a driver 27 to a gripper bar 13 for a trailing edge of a sheet 11. Given synchronous running of the active part 26 or the gripper bar 13 and the cylinders 5, 6, the gripper bar 13 dips centrally into the channel 16, as shown in more detail in FIG. 5.

Figure 6:
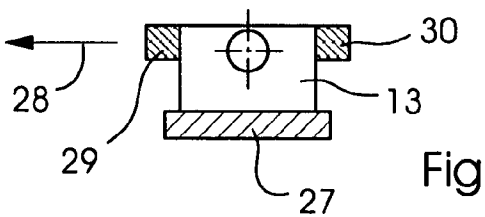
FIG. 6 is an elevational view of an elastomeric damper on a gripper bar.

FIG. 6 shows an enlarged section corresponding to the central portion of FIG. 5. In the conveying direction 28 of the sheets 11, there are rubber buffers 29, 30 having a damping action on both sides of the gripper bar 13.

On the journal 21, a collision disk 32 is held in a bearing 31. At the end, the collision disk 32 has a drilled hole 33 to accommodate a ball 34 of a ball detent inhibitor. The ball 34 is pressed into the drilled hole 33 with the force of a spring 35, it being possible for the ball 33 to be displaced in the axial direction of the transfer cylinder 6 in a drilled hole 36 at the end, and the spring 35 being supported in the drilled hole 36 on the transfer cylinder 6. When the ball 33 is seated in the drilled hole 33, a cutout 37 in the collision disk 32 corresponding to the shape of the channel 16 is aligned with the profile of the channel 16.

Furthermore, on the journal 21 there is a centering disk 38 fixed so as to rotate with it. The centering disk 38 has a centering groove 39, wherein a pin 40 engages, which is fixed laterally to the gripper bar 13. Given synchronous running of gripper bar 13 and transfer cylinder 6, the pin 40 runs along in the centering groove 39 without contact.

Furthermore, there is a collision disk 42 which can rotate on a bearing 41 and a centering disk 43 which is fixed on the journal 20 of the cylinder 5 so as to rotate with it. Between the collision disk 42 and the end of the impression cylinder 5 there is a further ball detent inhibitor 44. The centering disk 43 has a centering groove 45. The centering disk 43 having the centering groove 45 and the collision disk 42 having the ball detent inhibitor 44 interact with centering pins and rubber buffers on the gripper bars 12 for the leading edge of the sheets 11.

The rubber buffers 29, 30 on the gripper bars 12, 13 offer effective protection for the case wherein the gripper bars 12, 13 do not run synchronously with the impression cylinder 5 or with the transfer cylinder 6. If the gripper bars 12, 13 have a differential speed in relation to each other, then the gripper bars 12, 13 collide with the equal-height rubber buffers 29, 30, so that the energy of movement is converted into heat in the rubber buffers 29, 30.

In the event of slight asynchronism between a gripper bar 12, 13 and a cylinder 5, 6, the respective pin 40 is centered in the respective centering groove 39, 45 and the gripper bar 12, 13 is moved through the channel 15, 16 without any collision.

In the event of slight asynchronism, a gripper bar 12, 13 would collide with the surface of the cylinder 5, 6. Since, on the gripper bars 12, 13, the rubber buffers 29, 30 are located at the height of the respective collision disk 32, 42 in the axial direction of the cylinders 5, 6, the rubber buffers 29 run onto the circumferential surface of the relevant collision disk 32, 42. As a result, a braking moment acts on the relevant collision disk 32, 42. The collision disk 32, 42 comes to a standstill, while the relevant cylinder 5, 6 continues to rotate. The ball detent inhibitors 33-36, 44 act as a slipping clutch in this case, the force of the spring 45 determining the disengagement moment. Stopping a collision disk 32, 42 prevents the respective gripper bar 12, 13 being pulled into the press nip between impression cylinder 5 and transfer cylinder 6.

If a slipping clutch is disengaged, at the same time a signal can be generated, which acts on the drive controller of the linear motors and of the printing units 1-4 such that the sheet-fed press comes to a standstill.

In order to avoid a collision between the gripper bars 12, 13 and the cylinders 5, 6, there is also the possibility of arranging a barrier, such as a stop finger, upstream of the press nip. In the event of a fault in synchronism, the stop finger is moved in front of the press nip as a stop and prevents a gripper bar 12, 13 moving into the press nip. It is a precondition that the gripper bars 12, 13 are synchronized positively as they run through between the cylinders 5, 6, for example by means of centering disks 38, 43 and centering pins 40 described above.

This application claims the priority, under 35 U.S.C. § 119, of German patent application No. 10 2004 052 657.5, filed Oct. 29, 2004; the entire disclosure of the prior application is herewith incorporated by reference.

We claim:

1. An apparatus for conveying sheets through a rotary press, the rotary press having shaft journal-mounted cylinders that interact during printing, comprising:

grippers fixed to circulating links for conveying a sheet through a nip between the cylinders;

separately activated drives for driving said links and the cylinders, respectively;

a collision disk mounted on a shaft journal of at least one of the cylinders;

a slipping clutch disposed between said collision disk and the respective cylinder; and a braking element coupled to said grippers, said braking element being disposed to, in an event of non-synchronous running with the respective cylinder, run onto said collision disk and prevent a movement of said collision disk.

2. The apparatus according to claim 1, which further comprises a centering disk rigidly mounted to the shaft journal of at least one cylinder, said centering disk having a radially oriented centering groove formed therein, and a pin coupled to said grippers disposed to, during synchronous running with the cylinder, dip into said centering groove without contact and to run along said centering groove.

3. The apparatus according to claim 1, wherein said grippers include leading edge grippers for gripping a leading edge of a sheet and trailing edge grippers for gripping a trailing edge of the sheet, and said centering disk is one of two centering disks and said collision disk is one of two collision disks disposed on the shaft journals of each of the two cylinders.

4. The apparatus according to claim 1, wherein said braking element is an elastic rubber buffer.

5. The apparatus according to claim 2, wherein said pin is a substantially cylindrical pin.

6. The apparatus according to claim 1, which comprises linear motors disposed to drive said grippers.

7. The apparatus according to claim 1, which comprises a controller connected to said drives of said links and the cylinders, and wherein said controller is configured to stop said drive for the links after said braking element has run onto said collision disk.

* * * * *